United States Patent [19]

Chow

[11] Patent Number: 4,815,145

[45] Date of Patent: Mar. 28, 1989

[54] CONVERTIBLE BATHING SUIT

[76] Inventor: Rose Chow, 113 Ash Pl., Jacksonville, N.C. 28540

[21] Appl. No.: 172,548

[22] Filed: Mar. 24, 1988

[51] Int. Cl.[4] ..... A41D 7/00

[52] U.S. Cl. ..... 2/67; 2/69; 2/72

[58] Field of Search ..... 2/67, 69, 71, 72, 73, 2/213, 400, 431, 433, 429

[56] References Cited

U.S. PATENT DOCUMENTS

| | | | |
|---|---|---|---|
| 2,429,767 | 10/1947 | Oliensis | 128/431 |
| 3,002,193 | 10/1961 | Briskman | 2/72 |
| 4,301,545 | 11/1981 | Camarena | 2/67 |
| 4,306,317 | 12/1981 | Joseph | 2/67 |

FOREIGN PATENT DOCUMENTS

| | | | |
|---|---|---|---|
| 768593 | 8/1934 | France | 2/67 |
| 394555 | 6/1933 | United Kingdom | 2/67 |

*Primary Examiner*—Werner H. Schroeder
*Assistant Examiner*—Jeanette E. Chapman
*Attorney, Agent, or Firm*—Rhodes, Coats & Bennett

[57] ABSTRACT

This invention is a bikini type bathing suit which is convertible to a one piece bathing suit. This is accomplished through the provision of a removable midriff apron which attachs to the top and bottom of the bikini to effectively make the same a one piece bathing suit when desired.

9 Claims, 2 Drawing Sheets

Fig. 5A
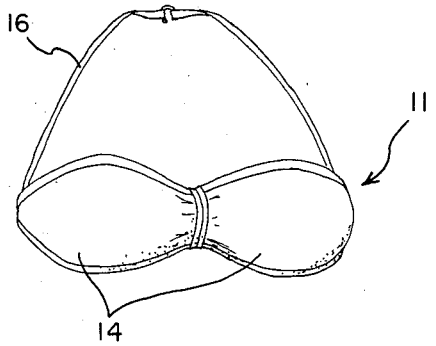
Fig. 4A
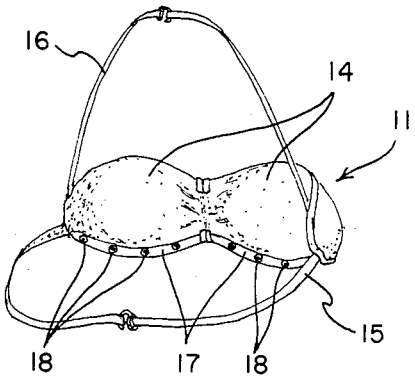
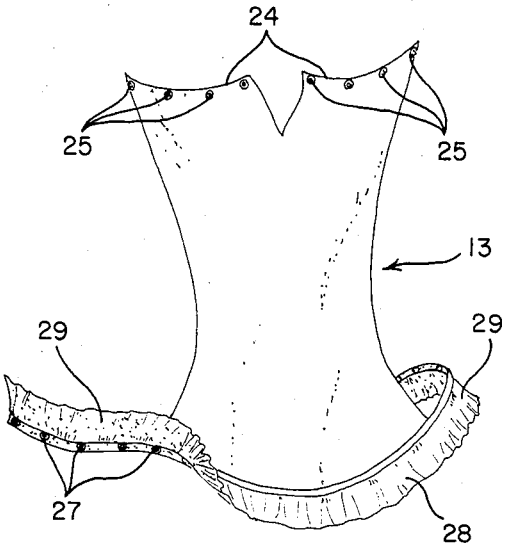
Fig. 5B
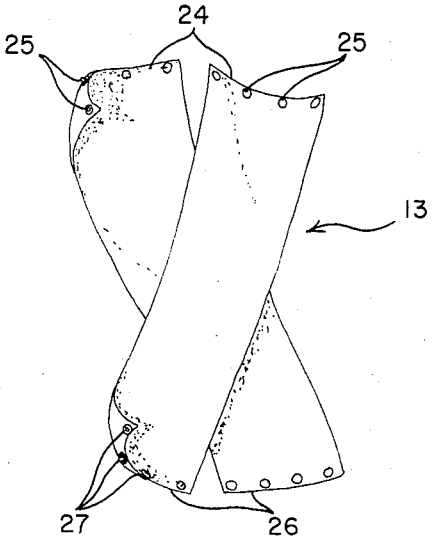
Fig. 4B
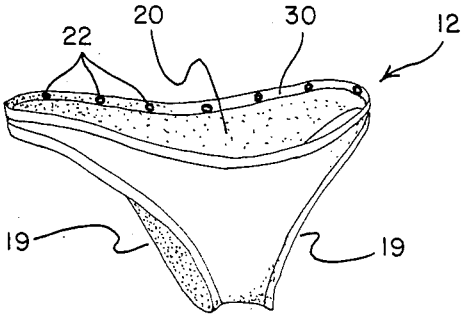
Fig. 5C
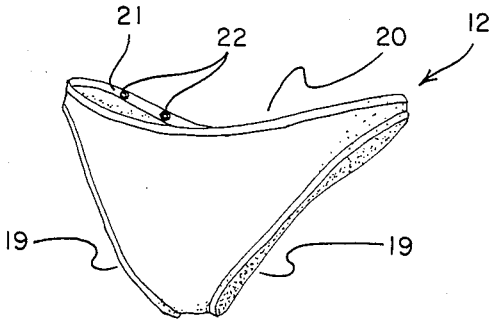
Fig. 4C

CONVERTIBLE BATHING SUIT

FIELD OF INVENTION

This invention relates to wearing apparel and more particularly to swimwear.

BACKGROUND OF INVENTION

When it first became acceptable for women to appear in public in bathing suits, the attire covered up a considerable portion of the body. Swimwear has since evolved to the tight fitting one piece bathing suit and then to the two piece bathing suit. From there swimwear has developed to the bikini with some of the very small ones being referred to as mini or micro bikinis.

These latter types are fine for the average woman to wear when swimming and sunbathing but are not suitable for spring board diving, water skiing, hydrosliding, and the like where the forces of the water are likely to partially or wholly disrobe the wearer thereof.

Also, the bikini types of bathing suits are generally not worn by women that have had midline incisions due to Caesarean Section births, hysterectomies, and the like. To still be able to get a suntan and yet not show their scars in public, two piece bathing suits are usually resorted to which can be folded down when in private. This is not a very acceptable alternative, however, to the woman who wants a genuine bikini suntan.

BRIEF DESCRIPTION OF INVENTION

After much research and study into the above-mentioned problems, the present invention has been developed to provide a means of allowing a woman to wear a bikini type bathing suit add yet, when appropriate, to convert the same to a one piece style suit. This is accomplished through the provision of a midriff apron which attachs below the cups of the top of the bikini and along the upper edge of the bottom of the bikini.

The convertible portion of the present invention can be designer attractive, which makes its utilitarian features even more desirable The wearer can effectively have a one piece bathing suit for diving, swimming, skiing, and the like and yet can have a normal bikini for sunbathing and general wear In view of the above, it is an object of the present invention to provide convertible swimwear which is readily connectable and separable.

Another object of the present invention is to provide a bikini type swimsuit which is convertible to the one piece type swimsuit.

Another object of the present invention is to provide a means for allowing a person to get a full bikini suntan and yet engage in strenuous water sports that normally require a one piece bathing suit.

Another object of the present invention is to provide a conversion panel which is readily attachable and detachable to and from a bikini type bathing suit to allow the same to be converted to a one piece suit.

Other objects and advantages of the present invention will become apparent and obvious from a study of the following description and the accompanying drawings which are merely illustrative of such invention.

BRIEF DESCRIPTION OF FIGURES

FIG. 4*a* is a rear perspective view of the top portion of the convertible bathing suit shown in FIG. 1;

FIG. 4*b* is a rear perspective view of the midriff portion of the convertible bathing suit shown in FIG. 1;

FIG. 4*c* is a rear perspective view of the bottom portion of the convertible bathing suit shown in FIG. 1;

FIG. 5*a* is a front perspective view of the top portion of the convertible bathing suit shown in FIG. 2;

FIG. 5*b* is a front perspective view of the midriff portion of the convertible bathing suit shown in FIG. 2; and FIG. 5*c* is a front perspective view of the bottom portion of the convertible bathing suit shown in FIG. 2.

DETAILED DESCRIPTION OF INVENTION

Figure 1:
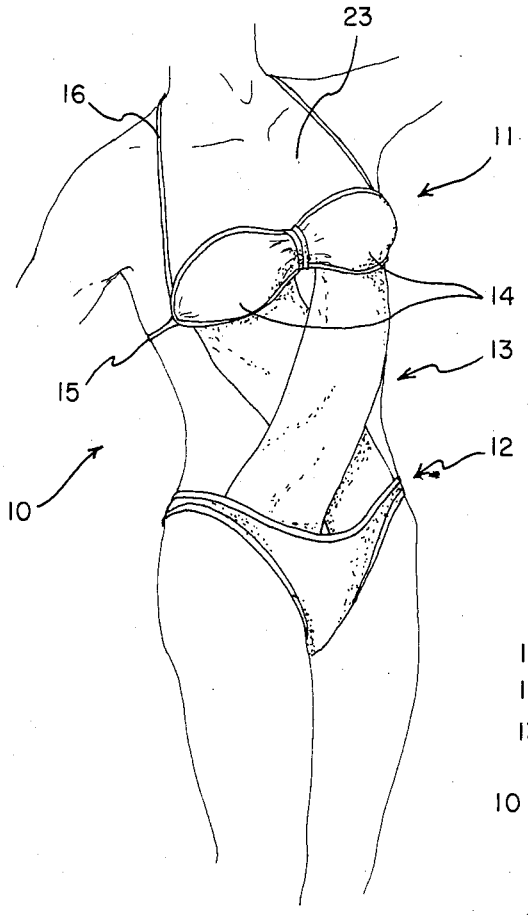
FIG. 1 is a front perspective view of the convertible bathing suit of the present invention in one piece configuration.
Figure 2:
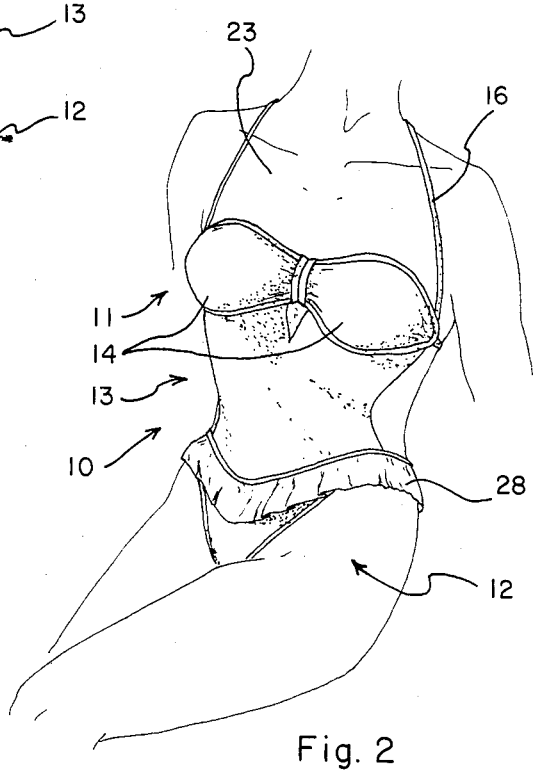
FIG. 2 is a front perspective view of a modified form of the one piece version of the present invention.

With further reference to the drawings, the convertible bathing suit of the present invention, indicated generally at 10, is composed of a top portion, indicated generally at 11, a bottom portion, indicated generally at 12, and a midriff portion, indicated generally at 13.

The top portion 11 includes the usual breast cups 14, back strap 15, and neck strap 16. Along the lower interior edge 17 of the breast cups 14 are a plurality of securing means such as female snap members 18.

The bottom portion 12 includes the usual leg openings 19 and body opening 20. The front interior edge 21 of body opening 20 includes a plurality of fastening means such as female snap members 22.

Since female snap members are generally flat and without projections, they lie comfortably against the skin of the wearer 23 thereof.

The midriff portion 13 includes an upper edge 24 which has a plurality of securing means such as male snap members 25 thereon which are so spaced to attachingly mate with the female snap members 18 on the lower interior edge 17 of the breast cups 14.

The lower edge 26 of midriff 13 includes a plurality of securing means such as male snap members 27 which are so spaced as to attachingly mate with the female snap members 22 on the front interior edge 21 of body opening 20.

Figure 3:
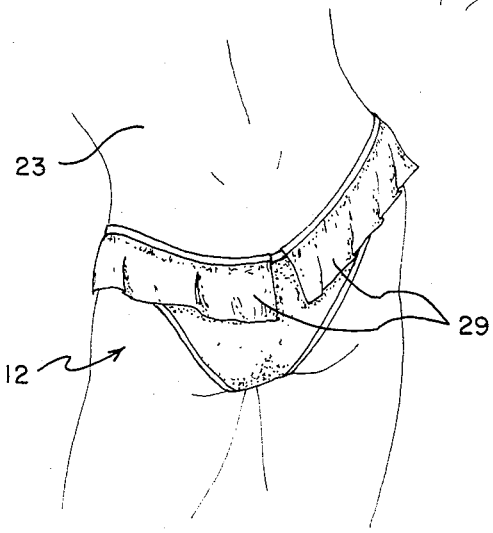
FIG. 3 is a rear perspective view of the version of the present invention shown in FIG. 2.

In the modified form of the convertible bathing suit 10 of the present invention shown in FIG. 5, a decorative ruffle 28 is provided along the lower exterior edge thereof and includes ruffle tails 29 which are adapted to be snapped into the rear interior edge 30 of body opening 20 and to flap outwardly over such upper edge as shown in FIG. 3.

To use the convertible bathing suit 10 of the present invention, the wearer 23 thereof puts on the top portion 11 and the bottom portion 12 in the normal manner. The wearer can then swim, sunbathe, and engage in the other normal activities where two piece or bikini type bathing suits are worn.

Whenever it is desired to engage in activities normally requiring a one-piece bathing suit, the wearer 23 simply takes the midriff portion 13 and secures the upper edge thereof to the lower interior edge of top portion 11 and the lower edge thereof to the front interior edge of body opening 20 of bottom portion 12. The wearer can then engage in any desired activities such as diving, swimming, skiing, and the like without concern that she will lose part of her bathing suit due to engaging in such activities.

Once the need for the midriff portion has passed, the user thereof can simply unsecure the same from the top and bottom portions 11 and 12 and return to wearing a bikini.

From the above it can be seen that the present invention provides a multi-purpose, convertible bathing suit which is attractive in appearance and yet is readily convertible from a bikini to a one piece bathing suit and back to a bikini. The present invention is also relatively inexpensive to produce and the midriff portion is readily storeable when not in use.

The present invention can, of course, be carried out in other specific ways than those herein set forth without departing from the spirit and essential characteristics of the invention The present embodiments are, therefore, to be considered in all respects as illustrative and not restrictive and all changes coming within the meaning and equivalency range of the appended claims are not intended to be embraced therein.

What is claimed is:

1. A convertible bathing suit type garment comprising: a top portion having securing means disposed along at least a portion of the lower edge thereof; a bottom portion having securing means secured along at least a portion of the upper edge thereof; and a midriff portion having securing means disposed along at least a portion of its upper and lower edges corresponding to the securing means of said top portion and bottom portion, respectively, whereby the upper edge of said midriff portion can be attached to the lower edge of said top portion, and the lower edge of said midriff portion can be attached to the upper edge of said bottom portion to form a one-piece style bathing suit or said midriff portion can be detached from said top portion and said bottom portion to form a two piece type bathing suit.

2. The combination bathing suit of claim 1 wherein the securing means between said top portion and said midriff portion are a plurality of snap type releasable attaching means.

3. The combination bathing suit of claim 1 wherein the securing means between said bottom portion and said midriff portion are a plurality of snap type releasable attaching means.

4. The combination bathing suit of claim 1 wherein the securing means between said top portion and said midriff portion, and said bottom portion and said midriff portion are a plurality of snap type releasable attaching means.

5. The convertible bathing suit of claim 1 wherein the midriff includes a decorative ruffle along the lower portion thereof.

6. The convertible bathing suit of claim 5 wherein said decorative ruffle includes ruffle tails which are secured about the periphery of the upper edges of said lower portion.

7. The convertible bathing suit of claim 1 wherein said midriff portion is formed from a single piece of fabric.

8. The convertible bathing suit of claim 1 wherein said midriff portion is formed from at least two pieces of fabric.

9. The convertible bathing suit of claim 1 wherein said top portion and said bottom portion are of the bikini type.

* * * * *